US012252942B2

(12) United States Patent
Zhang et al.

(10) Patent No.: US 12,252,942 B2
(45) Date of Patent: Mar. 18, 2025

(54) ROLLING AND SLIDING ADAPTIVE DEVICE FOR GUIDING AND FIXING DRILL PIPE

(71) Applicant: SICHUAN UNIVERSITY, Chengdu (CN)

(72) Inventors: Zetian Zhang, Chengdu (CN); Heping Xie, Chengdu (CN); Ru Zhang, Chengdu (CN); Ling Chen, Chengdu (CN); Yihang Li, Chengdu (CN); Heng Gao, Chengdu (CN); Jianan Li, Chengdu (CN); Wei Huang, Chengdu (CN); Li Ren, Chengdu (CN); Kun Xiao, Chengdu (CN); Weiqiang Ling, Chengdu (CN); Chendi Lou, Chengdu (CN)

(73) Assignee: SICHUAN UNIVERSITY, Chengdu (CN)

( * ) Notice: Subject to any disclaimer, the term of this patent is extended or adjusted under 35 U.S.C. 154(b) by 0 days.

(21) Appl. No.: 18/035,762

(22) PCT Filed: Sep. 23, 2022

(86) PCT No.: PCT/CN2022/120716
§ 371 (c)(1),
(2) Date: May 8, 2023

(87) PCT Pub. No.: WO2023/142500
PCT Pub. Date: Aug. 3, 2023

(65) Prior Publication Data

US 2024/0344410 A1 Oct. 17, 2024

(30) Foreign Application Priority Data

Jan. 26, 2022 (CN) ..... 202210091903.X

(51) Int. Cl.
*E21B 19/24* (2006.01)

(52) U.S. Cl.
CPC ..... *E21B 19/24* (2013.01)

(58) Field of Classification Search
CPC ..... E21B 19/24
See application file for complete search history.

(56) References Cited

U.S. PATENT DOCUMENTS 4,505,614 A * 3/1985 Anschutz ..... E21B 17/1007 294/902

FOREIGN PATENT DOCUMENTS

CN 101876237 A 11/2010
CN 107869317 A * 4/2018 ..... E21B 19/24
(Continued)

*Primary Examiner* — Matthew R Buck
(74) *Attorney, Agent, or Firm* — Bayramoglu Law Offices LLC

(57) ABSTRACT

A rolling and sliding adaptive device for guiding and fixing a drill pipe includes a mounting platform, where the mounting platform is provided with a through hole for the drill pipe to pass through. Multiple rolling and sliding support mechanisms are arranged around the through hole. The rolling and sliding support mechanisms each include a support seat. The support seat is provided with a contact element telescopic and swingable on the support seat. A telescopic drive mechanism is provided between the contact element and the support seat. The contact elements on the multiple rolling and sliding support mechanisms form a funnel-shaped structure with a large upper part and a small lower part around the through hole. The rolling and sliding adaptive device is used on a deep in-situ high-fidelity coring calibration platform for accurate positioning of an assembly process of a multi-section drill pipe bin.

9 Claims, 3 Drawing Sheets

(56) References Cited

FOREIGN PATENT DOCUMENTS

| | | | | | |
|---|---|---|---|---|---|
| CN | 110656909 | A | | 1/2020 | |
| CN | 210948545 | U | | 7/2020 | |
| CN | 111677468 | A | * | 9/2020 | |
| CN | 112177550 | A | * | 1/2021 | ..... E21B 19/24 |
| CN | 114423204 | A | | 4/2022 | |
| EP | 0454148 | A2 | | 10/1991 | |

* cited by examiner

ROLLING AND SLIDING ADAPTIVE DEVICE FOR GUIDING AND FIXING DRILL PIPE

CROSS REFERENCE TO THE RELATED APPLICATIONS

This application is the national phase entry of International Application No. PCT/CN2022/120716, filed on Sep. 23, 2022, which is based upon and claims priority to Chinese Patent Application No. 202210091903.X, filed on Jan. 26, 2022, the entire contents of which are incorporated herein by reference.

TECHNICAL FIELD

The present disclosure relates to the technical field of energy resource exploitation, in particular, to a rolling and sliding adaptive device for guiding and fixing a drill pipe.

BACKGROUND

In European and American countries, energy resources are generally buried at a depth of less than 2,000 m. In contrast, in China, more than 70% of the energy resources are buried at a depth of more than 2,000 m. In China, the shallow energy resources have been exhausted, and the energy resources go deeper into the Earth at a rate of more than 10 m every year. The country has increased its exploitation depth of oil and gas resources to 8,418 m, and its dependence on foreign oil import has reached 67%, far exceeding the internationally recognized energy security warning level. Thus, exploring energy resources in depth has become an urgent issue in China at present, and has become a major strategic scientific and technological issue and major energy security issue in China.

To dig into the deep earth, it is necessary to carry out research step by step from three aspects, namely, deep drilling, deep engineering scientific laws, and deep resource development and utilization, among which the most critical is the research of deep engineering scientific laws. The deep in-situ environment is very complex. Therefore, before the deep in-situ coring system is applied to on-site scientific drilling, it is necessary to carry out laboratory simulation to effectively verify the feasibility of the equipment and calibrate relevant parameters. This requires building a complete experimental simulation platform, but the assembly process faces problems in that the vertical centering assembly of long and large parts of the drill pipe bin system is complex and difficult to operate.

SUMMARY

To overcome the above shortcomings of the prior art, the present disclosure provides a rolling and sliding adaptive device for guiding and fixing a drill pipe, which can effectively assist in the centering, support, and fixation of drill pipe assembly.

To achieve the above objective, the present disclosure adopts the following technical solution:

The rolling and sliding adaptive device includes a mounting platform, where the mounting platform is provided with a through hole for the drill pipe to pass through. Multiple rolling and sliding support mechanisms are arranged around the through hole. The rolling and sliding support mechanisms each include a support seat; the support seat is provided with a contact element telescopic and swingable on the support seat. A telescopic drive mechanism is provided between the contact element and the support seat. The contact elements on the multiple rolling and sliding support mechanisms form a funnel-shaped structure with a large upper part and a small lower part around the through hole.

Further, the contact element includes two parallel and vertically arranged mounting plates. Multiple rolling shafts are evenly arranged between the two mounting plates. The multiple rolling shafts are vertically arranged, and two ends of each of the rolling shafts are rotationally arranged between the two mounting plates; the two mounting plates are arranged on the telescopic drive mechanism. The telescopic drive mechanism is movably provided on a mounting bracket provided at the upper end of the support seat.

Further, the upper end of each of the two mounting plates is provided with a bent part bent away from the drill pipe, and multiple rolling shafts are further arranged in the bent part.

Further, an annular groove mated with an outer circumference of the drill pipe is provided in the center of each of the rolling shafts. The annular groove has a concave arc-shaped surface and is in smooth fit with the surface of the rolling shaft.

Further, the telescopic drive mechanism includes an upper drive mechanism and a lower drive mechanism. The upper drive mechanism includes an upper guide-rod fixing plate hinged to the upper ends of the two mounting plates. The upper guide-rod fixing plate is provided with a movement drive mechanism for driving the upper guide-rod fixing plate to move toward the drill pipe. The lower drive mechanism includes a lower guide-rod fixing plate hinged to the lower ends of the two mounting plates. The lower guide-rod fixing plate is provided with a movement drive mechanism for driving the lower guide-rod fixing plate to move toward the drill pipe. The movement drive mechanisms are provided on the mounting bracket.

Further, the upper ends of the two mounting plates are connected by a locking bolt, and the lower ends of the two mounting plates are connected by a rotating shaft. Two ends of the rotating shaft are provided on the mounting plates through bearings. The rotating shaft is provided with a first hinge element hinged to a first hinge seat on the lower guide-rod fixing plate. The upper ends of the two mounting plates are respectively provided with a vertical first slide rail. The two first slide rails are respectively provided with a first slider. The two first sliders are connected through a connecting element. The connecting element is provided with a second hinge element hinged to a second hinge seat on the upper guide-rod fixing plate.

Further, the first slide rails are respectively provided in U-shaped grooves of the two mounting plates.

Further, the movement drive mechanisms include a guide screw rod. The guide screw rod has one end provided on the upper guide-rod fixing plate and the lower guide-rod fixing plate through a bearing. The guide screw rod has the other end provided with a motor seat through a bearing and connected in a transmission manner to a motor on the motor seat. The guide screw rod is provided with a screw rod nut provided on a nut mounting plate on the mounting bracket, and the guide screw rod passes through the nut mounting plate.

Further, multiple stabilizing guide rods are arranged between the upper guide-rod fixing plate and the motor seat, as well as between the lower guide-rod fixing plate and the motor seat. The multiple stabilizing guide rods are evenly distributed around the guide screw rod, and the stabilizing guide rods pass through and are slidably connected to the nut mounting plate.

Further, the lower end of the nut mounting plate is provided with a second slider, and the second slider is slidably provided on a second slide rail on the mounting platform.

The present disclosure has the following benefits. The rolling and sliding adaptive device is used on a deep in-situ high-fidelity coring calibration platform for accurate positioning of an assembly process of a multi-section drill pipe bin, thus ensuring the assembly accuracy of the multi-section drill pipe bin and stable support and fixation for the assembly and work of a coring system using the drill pipe. In addition, during the assembly of the drill pipe, the rolling and sliding adaptive device guides the drill pipe to ensure that the drill pipe is accurately oriented with the core bin below the mounting platform. Before assembly, the angles and spacing of the multiple contact elements are adjusted to form the funnel-shaped structure. The drill pipe is inserted into the center of the funnel-shaped structure formed by the multiple contact elements. As the drill pipe is inserted, the rolling shafts on the contact elements roll to avoid damaging the drill pipe, and they fit perfectly with the surface of the drill pipe to ensure an even support and fixation force.

Figure 1:
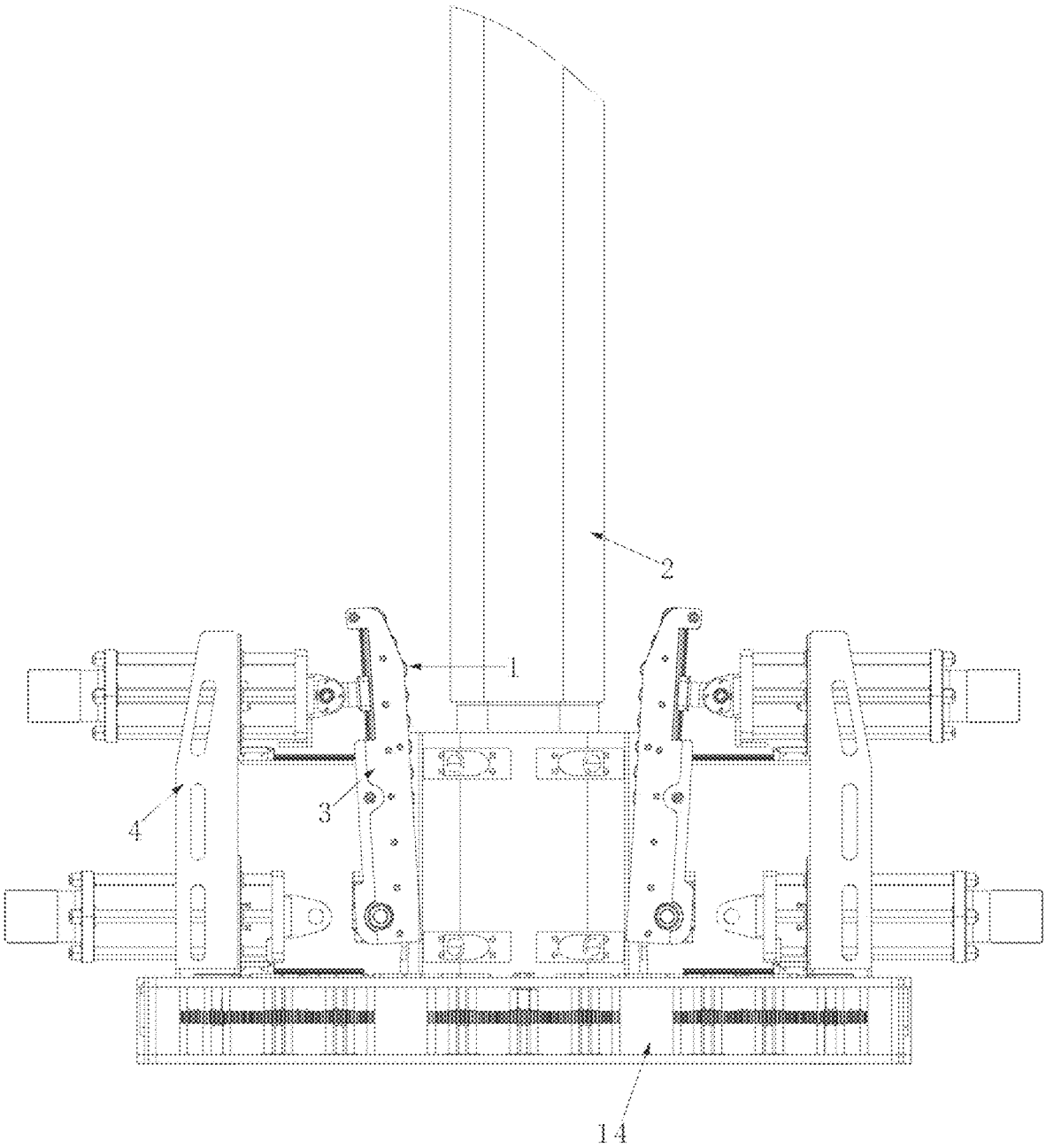
FIG. 1 is a mounting diagram of a rolling and sliding adaptive device for guiding and fixing a drill pipe.

Reference Numerals: 1. rolling shaft; 2. drill pipe; 3. mounting plate; 4. mounting bracket; 5. first hinge seat; 6. second slide rail; 7. lower guide-rod fixing plate; 8. motor seat; 9. nut mounting plate; 10. motor; 11. rotating shaft; 12. upper guide-rod fixing plate; 13. stabilizing guide rod; 14. mounting platform; 15. guide screw rod; 16. second hinge seat; 17. connecting element; 18. first slider; and 19. first slide rail.

DETAILED DESCRIPTION OF THE EMBODIMENTS

The specific implementations of the present disclosure are described below to facilitate those skilled in the art to understand the present disclosure, but it should be clear that the present disclosure is not limited to the scope of the specific implementations. Various obvious changes made by those of ordinary skill in the art within the spirit and scope of the present disclosure as defined by the appended claims should fall within the protection scope of the present disclosure.

Figure 2:
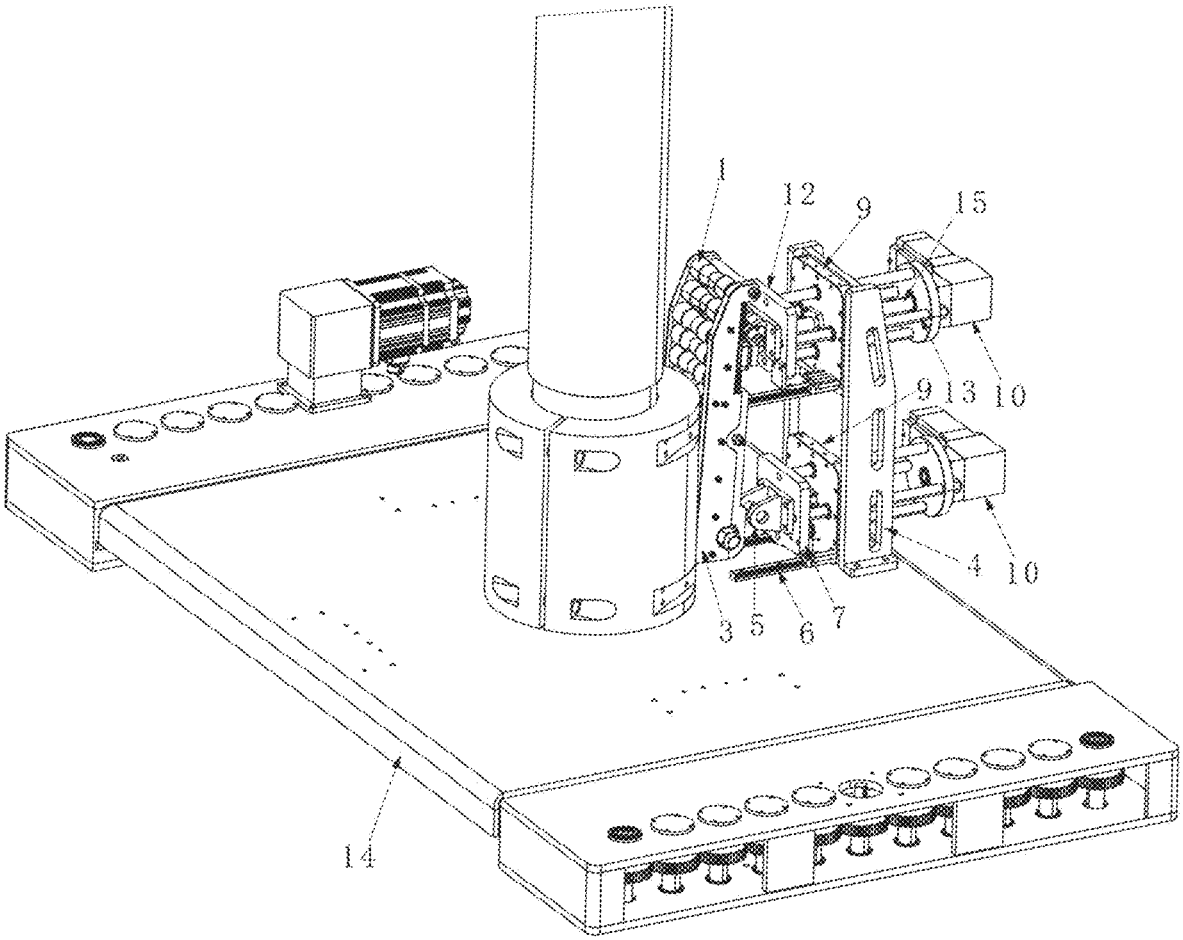
FIG. 2 is a schematic diagram of the rolling and sliding adaptive device in contact with the drill pipe.
Figure 3:
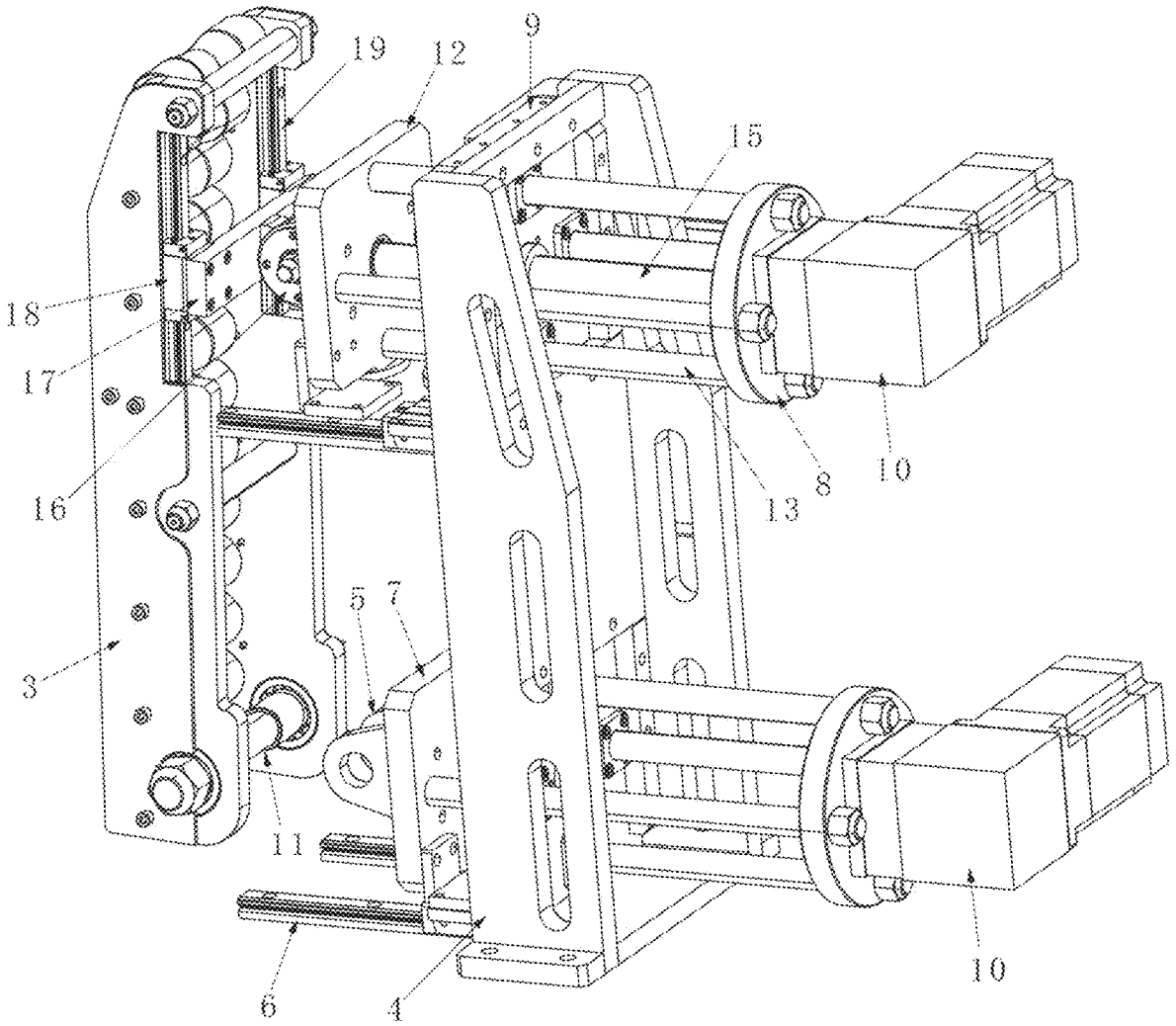
FIG. 3 is a schematic diagram of the rolling and sliding adaptive device for guiding and fixing the drill pipe.

As shown in FIGS. 1 to 3, in a solution, a rolling and sliding adaptive device for guiding and fixing drill pipe 2 includes mounting platform 14. The mounting platform 14 is provided with a through hole for the drill pipe 2 to pass through, and multiple rolling and sliding support mechanisms are arranged around the through hole. The rolling and sliding support mechanisms each include a support seat. The support seat is provided with a contact element telescopic and swingable on the support seat. A telescopic drive mechanism is provided between the contact element and the support seat. The contact elements on the multiple rolling and sliding support mechanisms form a funnel-shaped structure with a large upper part and a small lower part around the through hole.

In an implementation of this solution, the contact element includes two parallel and vertically arranged mounting plates 3. Multiple rolling shafts 1 are evenly arranged between the two mounting plates 3. The multiple rolling shafts 1 are vertically arranged, and two ends of each of the rolling shafts 1 are rotationally arranged between the two mounting plates 3. The two mounting plates 3 are arranged on the telescopic drive mechanism. The telescopic drive mechanism is movably provided on mounting bracket 4 provided at the upper end of the support seat.

An upper end of each of the two mounting plates 3 is provided with a bent part bent away from the drill pipe 2, and multiple rolling shafts 1 are further arranged in the bent part. When the multiple contact elements form the funnel-shaped structure around the through hole, the bent parts form an outwardly protruding edge at the upper end of the funnel-shaped structure to facilitate the insertion of the drill pipe 2 and other parts to avoid damage to the drill pipe 2.

This solution is used on a deep in-situ high-fidelity coring calibration platform for accurate positioning of an assembly process of a multi-section drill pipe bin. It ensures the assembly accuracy of the multi-section drill pipe 2 and long and large parts in the upper part of the drill pipe bin and provides stable support and fixation for the assembly and work of a coring system using the drill pipe 2. In addition, during the assembly of the drill pipe 2, this solution guides the drill pipe 2 to ensure that the drill pipe 2 is accurately oriented with the drill pipe bin below the mounting platform 14. Before assembly, the angles and spacing of the multiple contact elements are adjusted to form the funnel-shaped structure. The drill pipe 2 is inserted into the center of the funnel-shaped structure formed by the multiple contact elements. As the drill pipe 2 is inserted, the rolling shafts 1 on the contact elements roll to avoid damaging the drill pipe 2, and they fit perfectly with the surface of the drill pipe 2 to ensure an even support and fixation force.

In the implementation of this solution, an annular groove mated with the outer circumference of the drill pipe 2 is provided in the center of each of the rolling shafts 1. The annular groove has a concave arc-shaped surface and is in smooth fit with the surface of the rolling shaft 1. This design facilitates the contact between the rolling shaft 1 and the drill pipe 2 and prevents the annular groove from damaging the surface of the drill pipe 2.

In the implementation of this solution, the telescopic drive mechanism includes an upper drive mechanism and a lower drive mechanism. The upper drive mechanism includes upper guide-rod fixing plate 12. The upper guide-rod fixing plate 12 is hinged to the upper ends of the two mounting plates 3. The upper guide-rod fixing plate 12 is provided with a movement drive mechanism for driving the upper guide-rod fixing plate 12 to move toward the drill pipe 2. The lower drive mechanism includes lower guide-rod fixing plate 7. The lower guide-rod fixing plate 7 is hinged to the lower ends of the two mounting plates 3. The lower guide-rod fixing plate 7 is provided with a movement drive mechanism for driving the lower guide-rod fixing plate 7 to move toward the drill pipe 2. The movement drive mechanisms are provided on the mounting bracket 4.

The upper ends of the two mounting plates 3 are connected by a locking bolt, and the lower ends of the two mounting plates 3 are connected by a rotating shaft 11. Two ends of the rotating shaft 11 are provided on the mounting plate 3 through bearings. The rotating shaft 11 is provided with a first hinge element hinged to a first hinge seat 5 on the lower guide-rod fixing plate 7. The upper ends of the two mounting plates 3 are respectively provided with a vertical first slide rail 19. The two first slide rails 19 are respectively provided with a first slider 18. The two first sliders 18 are connected through connecting element 17. The connecting element 17 is provided with a second hinge element hinged to a second hinge seat 16 on the upper guide-rod fixing plate 12.

When the angle of the contact element is adjusted, the upper and lower ends of the contact element can be adjusted synchronously with a high degree of freedom, a stable support force, and a stable structure. The first slide rails 19 are respectively provided in U-shaped grooves of the two mounting plates 3 to facilitate stable vertical positioning and mounting of the first slide rails 19.

The movement drive mechanisms include a guide screw rod 15. The guide screw rod 15 has one end provided on the upper guide-rod fixing plate 12 and the lower guide-rod fixing plate 7 through a bearing. The guide screw rod 15 has the other end provided with motor seat 8 through a bearing and connected in a transmission manner to motor 10 on the motor seat 8. The guide screw rod 15 is provided with a screw rod nut provided on nut mounting plate 9 that is positioned on the mounting bracket 4, and the guide screw rod 15 passes through the nut mounting plate 9. The motor 10 rotates to drive the guide screw rod 15 to drive the upper and lower ends of the contact element to swing at different angles. The guide screw rod 15 is stably mated with the screw rod nut.

Multiple stabilizing guide rods 13 are arranged between the upper guide-rod fixing plate 12 and the motor seat 8, as well as between the lower guide-rod fixing plate 7 and the motor seat 8. The multiple stabilizing guide rods 13 are evenly distributed around the guide screw rod 15. The stabilizing guide rods 13 pass through the nut mounting plate 9 and are slidably connected to the nut mounting plate 9. The stabilizing guide rods 13 further increase the movement stability of the guide screw rod 15 and reduce the error caused by vibration. A lower end of the nut mounting plate 9 is provided with a second slider. The second slider is slidably provided on second slide rail 6 on the mounting platform 14. This design further ensures the movement stability of the upper guide-rod fixing plate 12 and the lower guide-rod fixing plate 7.

What is claimed is:

1. A rolling and sliding adaptive device for guiding and fixing a drill pipe, comprising a mounting platform, wherein the mounting platform is provided with a through hole for the drill pipe to pass through;

a plurality of rolling and sliding support mechanisms are arranged around the through hole;

the plurality of rolling and sliding support mechanisms each comprise a support seat;

the support seat is provided with a contact element, wherein the contact element is telescopic and swingable on the support seat;

a telescopic drive mechanism is provided between the contact element and the support seat; and the contact elements on the plurality of rolling and sliding support mechanisms form a funnel-shaped structure with a large upper part and a small lower part around the through hole, wherein the contact element comprises two parallel mounting plates, and the two parallel mounting plates are vertically arranged;

a plurality of rolling shafts are evenly arranged between the two parallel mounting plates;

the plurality of rolling shafts are vertically arranged, and two ends of each of the plurality of rolling shafts are rotationally arranged between the two parallel mounting plates;

the two parallel mounting plates are arranged on the telescopic drive mechanism;

the telescopic drive mechanism is movably provided on a mounting bracket provided at an upper end of the support seat;

the telescopic drive mechanism comprises an upper drive mechanism and a lower drive mechanism;

the upper drive mechanism comprises an upper guide-rod fixing plate, wherein the upper guide-rod fixing plate is hinged to upper ends of the two parallel mounting plates;

the upper guide-rod fixing plate is provided with a movement drive mechanism for driving the upper guide-rod fixing plate to move toward the drill pipe;

the lower drive mechanism comprises a lower guide-rod fixing plate, wherein the lower guide-rod fixing plate is hinged to lower ends of the two parallel mounting plates;

the lower guide-rod fixing plate is provided with a movement drive mechanism for driving the lower guide-rod fixing plate to move towards the drill pipe; and the movement drive mechanisms are provided on the mounting bracket.

2. The rolling and sliding adaptive device according to claim 1, wherein an upper end of each of the two parallel mounting plates is provided with a bent part bent away from the drill pipe, and the plurality of rolling shafts are further arranged in the bent part.

3. The rolling and sliding adaptive device according to claim 2, wherein an annular groove is provided in a center of each of the plurality of rolling shafts, wherein the annular groove is mated with an outer circumference of the drill pipe; and the annular groove has a concave arc-shaped surface and is in smooth fit with a surface of the rolling shaft.

4. The rolling and sliding adaptive device according to claim 2, wherein an annular groove is provided in a center of each of the plurality of rolling shafts, wherein the annular groove is mated with an outer circumference of the drill pipe; and the annular groove has a concave arc-shaped surface and is in smooth fit with a surface of the rolling shaft.

5. The rolling and sliding adaptive device according to claim 1, wherein the upper ends of the two parallel mounting plates are connected by a locking bolt, and the lower ends of the two parallel mounting plates are connected by a rotating shaft;

two ends of the rotating shaft are provided on the two parallel mounting plates through bearings;

the rotating shaft is provided with a first hinge element, wherein the first hinge element is hinged to a first hinge seat, wherein the first hinge seat is on the lower guide-rod fixing plate;

the upper ends of the two parallel mounting plates are respectively provided with a vertical first slide rail;

the two first slide rails are respectively provided with a first slider;

the two first sliders are connected through a connecting element; and the connecting element is provided with a second hinge element, wherein the second hinge element is hinged to a second hinge seat, wherein the second hinge seat is on the upper guide-rod fixing plate.

6. The rolling and sliding adaptive device according to claim 1, wherein first slide rails are respectively provided in U-shaped grooves of the two parallel mounting plates.

7. The rolling and sliding adaptive device according to claim 1, wherein the movement drive mechanisms comprise a guide screw rod;

the guide screw rod has a first end provided on the upper guide-rod fixing plate and the lower guide-rod fixing plate through a first bearing;

the guide screw rod has a second end provided with a motor seat through a second bearing and connected in a transmission manner to a motor on the motor seat;

the guide screw rod is provided with a screw rod nut, wherein the screw rod nut is provided on a nut mounting plate on the mounting bracket; and the guide screw rod passes through the nut mounting plate.

8. The rolling and sliding adaptive device according to claim 7, wherein a plurality of stabilizing guide rods are arranged between the upper guide-rod fixing plate and the motor seat and between the lower guide-rod fixing plate and the motor seat;

the plurality of stabilizing guide rods are evenly distributed around the guide screw rod; and the plurality of stabilizing guide rods pass through and are slidably connected to the nut mounting plate.

9. The rolling and sliding adaptive device according to claim 7, wherein a lower end of the nut mounting plate is provided with a second slider; and the second slider is slidably provided on a second slide rail, wherein the second slide rail is mounted on the mounting platform.

* * * * *